US010139148B2

(12) United States Patent
Pérez López et al.

(10) Patent No.: US 10,139,148 B2
(45) Date of Patent: Nov. 27, 2018

(54) METHODS AND APPARATUS FOR COOLING LIQUIDS IN PORTABLE CONTAINERS

(71) Applicant: ICEJET, S.L., Gava Barcelona (ES)

(72) Inventors: Gustavo Pérez López, Gava Barcelona (ES); José María Nacenta Anmella, Barcelona (ES)

(73) Assignee: ICEJET, S.L., Gava Barcelona (ES)

( * ) Notice: Subject to any disclaimer, the term of this patent is extended or adjusted under 35 U.S.C. 154(b) by 418 days.

(21) Appl. No.: 14/577,463

(22) Filed: Dec. 19, 2014

(65) Prior Publication Data

US 2016/0178293 A1 Jun. 23, 2016

(51) Int. Cl.

| | |
|---|---|
| ***F25D 3/10*** | (2006.01) |
| ***F28F 13/06*** | (2006.01) |
| *F28D 7/02* | (2006.01) |

(52) U.S. Cl.

CPC ..... *F25D 3/107* (2013.01); *F28F 13/06* (2013.01); *F28D 7/024* (2013.01)

(58) Field of Classification Search

CPC ..... F25D 3/107; F28D 7/12
USPC ..... 165/142; 62/293, 294, 457.3, 457.9
See application file for complete search history.

(56) References Cited

U.S. PATENT DOCUMENTS

| | | | | |
|---|---|---|---|---|
| 2,193,141 A * | 3/1940 | Price | B64D 13/08 | 122/32 |
| 2,685,132 A * | 8/1954 | Karr | A01J 9/04 | 165/118 |
| 2,805,554 A | 9/1957 | Schachtsiek | | |
| 3,269,141 A | 8/1966 | Weiss | | |
| 4,341,263 A | 7/1982 | Arbabian | | |
| 5,331,817 A * | 7/1994 | Anthony | A47J 36/28 | 62/293 |
| 5,365,750 A * | 11/1994 | Greenthal | F25D 15/00 | 165/142 |
| 5,655,384 A * | 8/1997 | Joslin, Jr. | F25D 3/107 | 126/263.09 |

(Continued)

FOREIGN PATENT DOCUMENTS

| | | | |
|---|---|---|---|
| CN | 1183084 A | 5/1998 | |
| EP | 2447632 A1 * | 5/2012 | F25D 3/107 |

(Continued)

OTHER PUBLICATIONS

Extended European Search Report (EESR) for European Application No. 15157861.4, issued by the European Patent Office dated Jul. 30, 2015, 7 pages, Munich Germany.

(Continued)

*Primary Examiner* — Allen Flanigan
(74) *Attorney, Agent, or Firm* — Edell, Shapiro & Finnan, LLC

(57) ABSTRACT

An assembly for cooling a liquid inside a portable container. According to some implementations the portable container has a heat exchanger assembly disposed therein with the heat exchanger assembly including a coolant pre-cooling assembly. According to the same or other implementations a tortuous coolant fluid passage that runs through at least a portion of the heat exchanger assembly includes one or more constrictions for controlling the evaporation temperature of the coolant along the length of the passage.

14 Claims, 9 Drawing Sheets

(56) References Cited

U.S. PATENT DOCUMENTS

| | | | | |
|---|---|---|---|---|
| 5,749,242 | A * | 5/1998 | Mowery | F25B 39/02 165/142 |
| 6,125,649 | A * | 10/2000 | Sillince | C09K 5/00 62/294 |
| 6,128,906 | A | 10/2000 | Sillince | |
| 6,151,901 | A * | 11/2000 | Dobak, III | A61B 18/02 606/23 |
| 6,443,334 | B1 | 9/2002 | John | |
| 6,830,661 | B1 | 12/2004 | Land | |
| 6,854,280 | B2 | 2/2005 | Jeuch | |
| 7,028,505 | B2 | 4/2006 | Cardinale | |
| 7,217,343 | B2 | 5/2007 | Land | |
| 2002/0178743 | A1 | 12/2002 | Halimi | |
| 2003/0159448 | A1 | 8/2003 | Lee | |
| 2005/0142269 | A1 | 6/2005 | Scullion | |
| 2005/0235657 | A1 | 10/2005 | Boukas | |
| 2007/0044488 | A1 | 3/2007 | Habatjou | |
| 2007/0101734 | A1 | 5/2007 | Lucas | |
| 2008/0073358 | A1 | 3/2008 | Jeuch et al. | |

FOREIGN PATENT DOCUMENTS

| | | | |
|---|---|---|---|
| FR | 1517060 | A | 3/1968 |
| FR | 2810015 | A1 | 12/2001 |
| WO | WO9637742 | A1 | 11/1996 |
| WO | WO2011128486 | | 10/2011 |

OTHER PUBLICATIONS

English Translation of the International Search Report (ISR) and Written Opinion (ISA), International Application No. PCT/ES2011/070262 International Filing Date Apr. 15, 2011 dated Aug. 10, 2011, 6 pages, Spanish Office of Patents and Trademarks, Madrid Spain.

Spanish International Search Report (ISR) and Written Opinion (ISA), International Application No. PCT/ES2011/070262 International Filing Date Apr. 15, 2011 dated Aug. 10, 2011, 6 pages, Spanish Office of Patents and Trademarks, Madrid Spain.

* cited by examiner

METHODS AND APPARATUS FOR COOLING LIQUIDS IN PORTABLE CONTAINERS

TECHNICAL FIELD

The present invention relates to methods and apparatus for cooling liquids carried in portable containers such as hand-held liquid containers, liquid containers housed in backpacks, etc.

SUMMARY OF THE DISCLOSURE

According to some implementations a cooling apparatus is provided that comprises: a first longitudinal body having a first outer surface and a first inner surface, the first inner surface defining an internal chamber having first and second ends; a second longitudinal body disposed inside the first longitudinal body, the second longitudinal body having a second outer surface and a second inner surface, the second outer surface facing and being spaced-apart from the first inner surface of the first longitudinal body, the second inner surface defining an internal cavity having first and second ends, the first end being disposed in proximity to the first end of the internal chamber of the first longitudinal body, the second end being disposed in proximity to the second end of the internal chamber of the first longitudinal body; a tortuous conduit disposed between and along a length of the first and second longitudinal bodies, the tortuous conduit being defined in part by the inner surface of the first longitudinal body, the tortuous conduit having an outlet and an inlet that are respectively disposed in proximity to the first and second ends of the internal chamber of the first longitudinal body, the tortuous conduit outlet being in fluid communication with the internal cavity of the second longitudinal body; a coolant exhaust duct that exhausts to the atmosphere and that is in fluid communication with the second end of the internal cavity of the second longitudinal body; and a coolant pre-cooling coil assembly disposed inside the internal cavity of the second longitudinal body between the outlet of the tortuous conduit and the coolant exhaust duct, the coil assembly comprising a coolant inlet and a coolant outlet that is in fluid communication with the tortuous conduit inlet.

According to some implementations an assembly is provided that comprises a cooling apparatus including: a first longitudinal body having a first outer surface and a first inner surface, the first inner surface defining an internal chamber having first and second ends; a second longitudinal body disposed inside the first longitudinal body, the second longitudinal body having a second outer surface and a second inner surface, the second outer surface facing and being spaced-apart from the first inner surface of the first longitudinal body, the second inner surface defining an internal cavity having first and second ends, the first end being disposed in proximity to the first end of the internal chamber of the first longitudinal body, the second end being disposed in proximity to the second end of the internal chamber of the first longitudinal body; a tortuous conduit disposed between and along a length of the first and second longitudinal bodies, the tortuous conduit being defined in part by the inner surface of the first longitudinal body, the tortuous conduit having an outlet and an inlet that are respectively disposed in proximity to the first and second ends of the internal chamber of the first longitudinal body, the tortuous conduit outlet being in fluid communication with the internal cavity of the second longitudinal body; a coolant exhaust duct in fluid communication with the second end of the internal cavity of the second longitudinal body; a coolant pre-cooling coil assembly disposed inside the internal cavity of the second longitudinal body between the outlet of the tortuous conduit and the coolant exhaust duct, the coil assembly comprising a coolant inlet and a coolant outlet that is in fluid communication with the tortuous conduit inlet; and a hand-held liquid container having a first end, a second end and a cavity disposed between the first and second ends for housing a liquid, the first end comprising an opening for receiving or emptying a liquid from the container, at least a majority of the first and second longitudinal bodies of the cooling apparatus residing inside the cavity.

According to some implementations a cooling apparatus is provided that comprises: a first longitudinal body having a first outer surface and a first inner surface, the first inner surface defining an internal chamber having first and second ends; a second longitudinal body disposed inside the first longitudinal body, the second longitudinal body having a second outer surface and a second inner surface, the second outer surface facing and being spaced-apart from the first inner surface of the first longitudinal body, the second inner surface defining an internal cavity having first and second ends, the first end being disposed in proximity to the first end of the internal chamber of the first longitudinal body, the second end being disposed in proximity to the second end of the internal chamber of the first longitudinal body; and a tortuous conduit disposed between and along a length of the first and second longitudinal bodies, the tortuous conduit being defined in part by the inner surface of the first longitudinal body, the tortuous conduit having an outlet and an inlet that are respectively disposed in proximity to the first and second ends of the internal chamber of the first longitudinal body, the tortuous conduit outlet being in fluid communication with the internal cavity of the second longitudinal body, the tortuous conduit comprising one or more flow constrictors disposed within an intermediate portion thereof.

According to some implementations a method is provided that includes (i) obtaining a portable liquid container having disposed in a cavity therein a heat exchanger configured for cooling a liquid, (ii) partially filling the cavity of the portable container with a liquid, (iii) connecting a cooling source to the heat exchanger to initiate a flow of a cooling medium through the heat exchanger, and (iv) shaking the portable container while the cooling medium is being delivered through the heat exchanger.

These, as well as other exemplary implementations, are illustrated and described in a non-limiting manner in the drawings and detailed description.

DETAILED DESCRIPTION

Figure 1A:
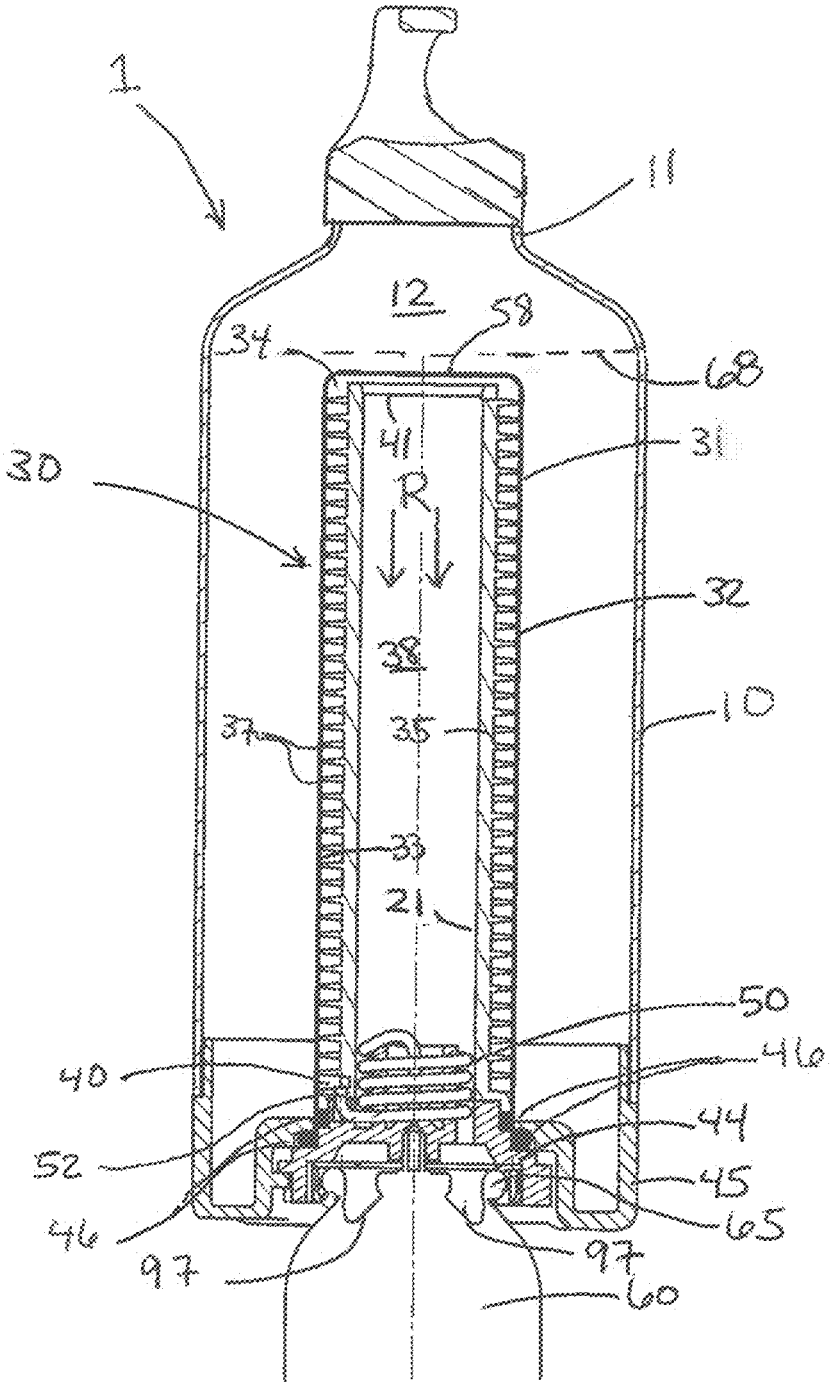
FIG. 1A illustrates a partial cross-sectional view of a cooling assembly according to one implementation.
Figure 1B:
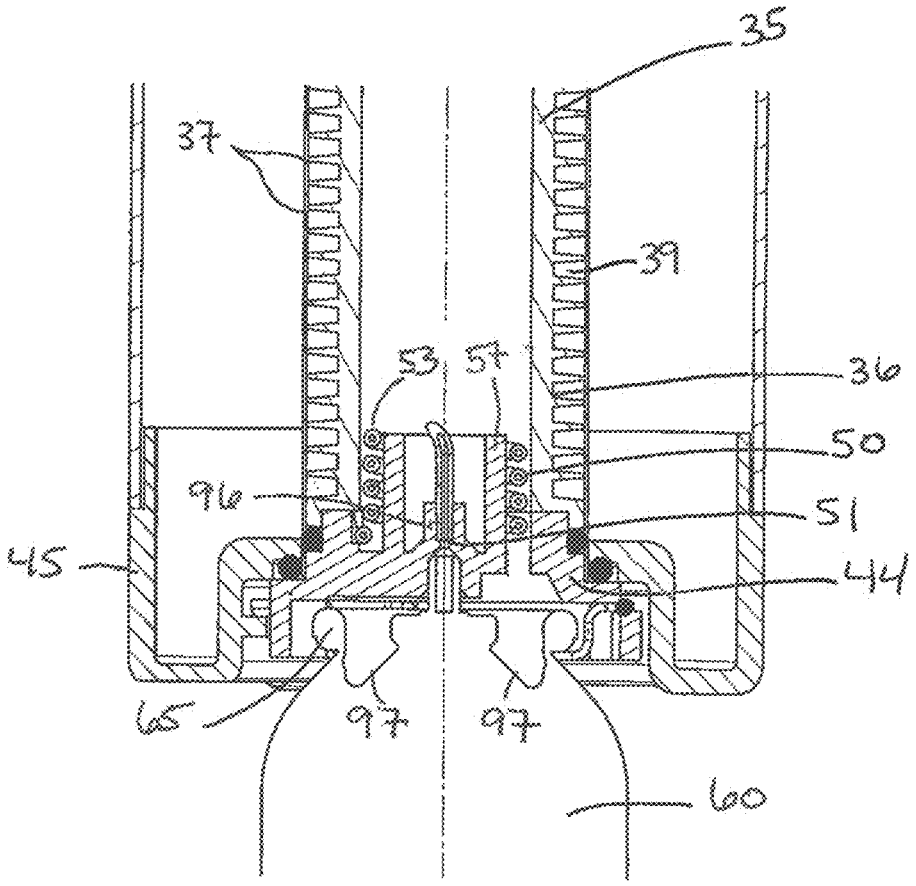
FIG. 1B illustrates an enlarged cross-section view of a portion of the assembly of FIG. 1A.
Figure 1C:
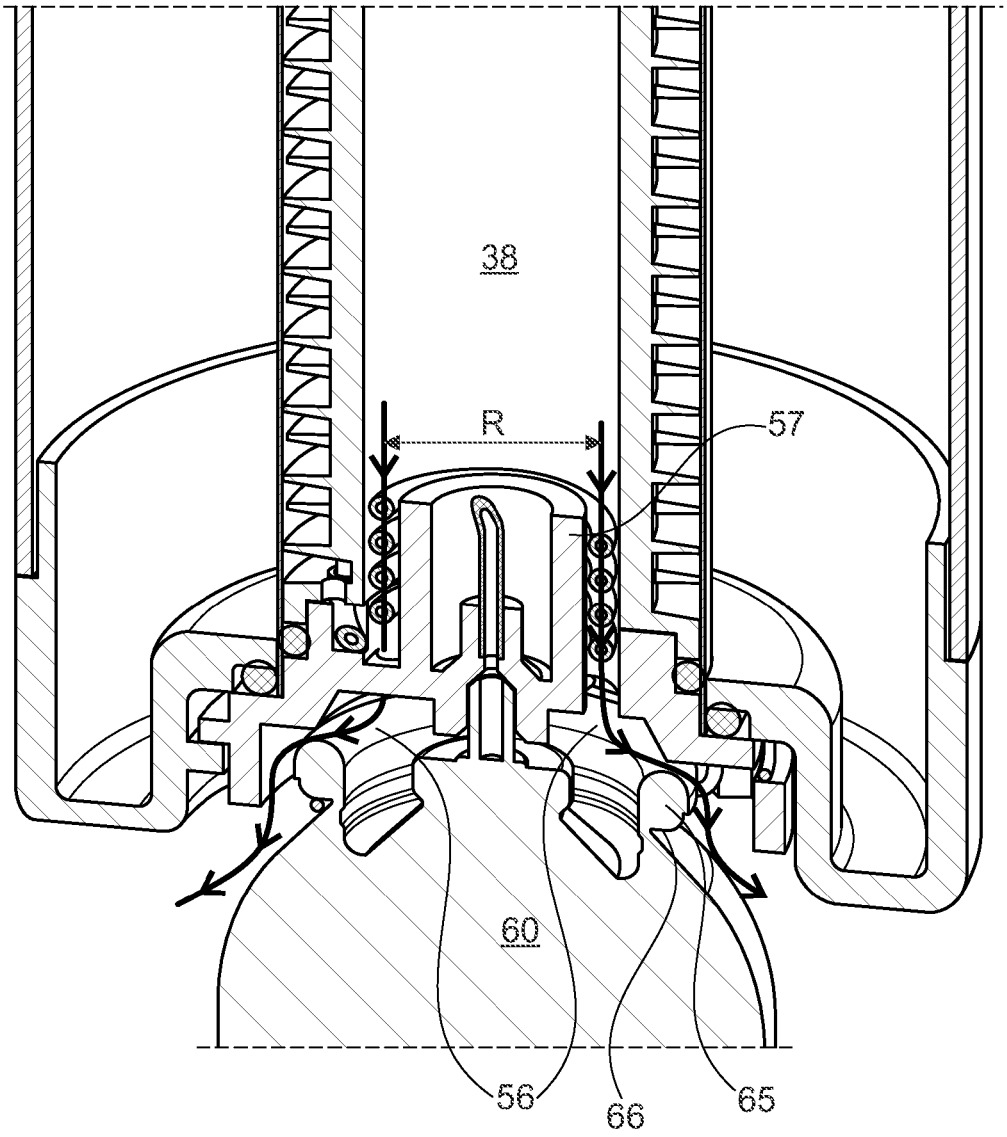
FIG. 1C is a three-dimensional cross-sectional view of a portion of the assembly of FIG. 1B.

FIGS. 1A-C illustrate an assembly 1 comprising a hand-held liquid container 10 having an internal cavity 12 in which is housed at least in part a cooling apparatus/heat exchanger 30. The cooling apparatus 30 includes an external longitudinal body 31 having an outer wall surface 32 and an inner wall surface 33, the inner wall surface 33 defining an internal chamber 34 that extends along a length of the body 31. Disposed within the internal chamber 34 of the external longitudinal body 31 is an internal longitudinal body 35. The internal longitudinal body 35 has an outer wall surface 36 spaced-apart from the inner wall surface 33 of body 31 wherein which one or more flow diverting elements 37 is/are disposed to form a tortuous fluid passage 39. Body 35 also includes an inner wall surface 21 that defines an internal cavity 38. According to some implementations the tortuous fluid passage 39 has an inlet 40 disposed at a location along the length of bodies 31, 35 (for example, at or near a first end of the bodies 31, 35 as depicted in FIG. 1A) and an outlet 41 that leads into the internal cavity 38. The internal cavity 38 in turn exhausts to the atmosphere which will be discussed in more detail below.

In use, a pressurized cooling fluid is introduced into the tortuous fluid passage 39 through the inlet 40 and undergoes expansion. As the cooling fluid expands a cooling occurs with the external longitudinal body 31 being cooled and absorbing heat from the liquid located inside the internal cavity 12 of the hand-held liquid container 10. According to some implementations the thermal conductivity of body 31 is greater than the thermal conductivity of body 35. According to such implementations, body 31 may be made of a light-weight metallic material, such as aluminum, and body 35 may be made of a plastic material, such as a polyamide.

According to some implementations, and not all, the cooling apparatus 30 further includes a coil assembly 50 located in the internal cavity 38 of body 35. The coil assembly 50 includes a coolant inlet 51 and a coolant outlet 52 that is in fluid communication with the inlet 40 of the tortuous fluid passage 39. According to some implementations, the coil assembly 50 is disposed at or near a proximal end of body 35. That is, at an end near the inlet 40 of the tortuous fluid passage 39. The inlet duct 51 is in turn connectable to a reservoir or cartridge 60 that prior to activation contains a coolant in the form of a liquefied gas.

The coil assembly 50 includes one or more coils 53 through which the coolant is initially received and transported from the inlet 51 of the cooling apparatus 30 to the inlet 40 of the tortuous fluid passage 39. The one or more coils 53 are constructed of a material having a high thermal conductivity, such as copper. In use, when the cooling fluid is being delivered through the cooling apparatus and exhausted to the atmosphere through the internal cavity 38 of body 35, the coolant is delivered through the cavity 38 and across the exterior surface of the coils 53 of the coil assembly 50 prior to being exhausted to the atmosphere. FIG. 1C illustrates a representative flow R of the coolant as it passes through the coil assembly 50 and out through an exhaust duct 56. The purpose of the coil assembly 50 is to effectuate a cooling of the coolant prior to its introduction into the inlet 40 of the tortuous fluid passage 39. Cooling occurs as a result of heat from the coolant passing through the coil assembly 50 being transferred through the thermally conductive walls of the coils 53 to the exhausting coolant. As a result of pre-cooling the coolant prior to it being introduced into the tortuous fluid passage 39, the over-all cooling efficiency of the cooling apparatus 30 is increased.

Another advantage associated with the use of the coil assembly 50 is that it reduces the likelihood of the occurrence of unevaporated coolant passing from the cavity 38 of body 35 and into the exhaust duct 56. This is a result of the coolant absorbing energy as it passes through the coils 53 of the coil assembly 50.

In the implementation shown in the FIGS. 1 and 2 the diverting elements 37 comprise a plurality of axially spaced apart ring elements 37*a* that form a part with and extend radially from the outer surface 36 of the body 35 with through openings 37*b* formed longitudinally therein. According to some implementations the through openings 37*b* of adjacent ring elements 37*a* are not longitudinally aligned with one another so as to create the tortuous fluid path. As shown in FIGS. 2D and 2E (which may represent adjacent ring elements), the through openings 37*b* of adjacent ring elements 37*a* may be located approximately 180 degrees apart, although other angular orientations are possible. In such implementations the through openings of every other ring element 37*a* may be longitudinally aligned with one another. Further, as will be discussed in more detail below, the width of the longitudinal through openings 37*b* in the ring elements 37 may vary along the length of the body 35 as illustrated in FIGS. 2D and 2E wherein which the width dimension W1 (or cross-sectional area) of a through opening 37*b* in one ring element 37 is greater the width dimension W2 (or cross-sectional area) of a through opening 37*b* in another ring element 37.

Figure 5:
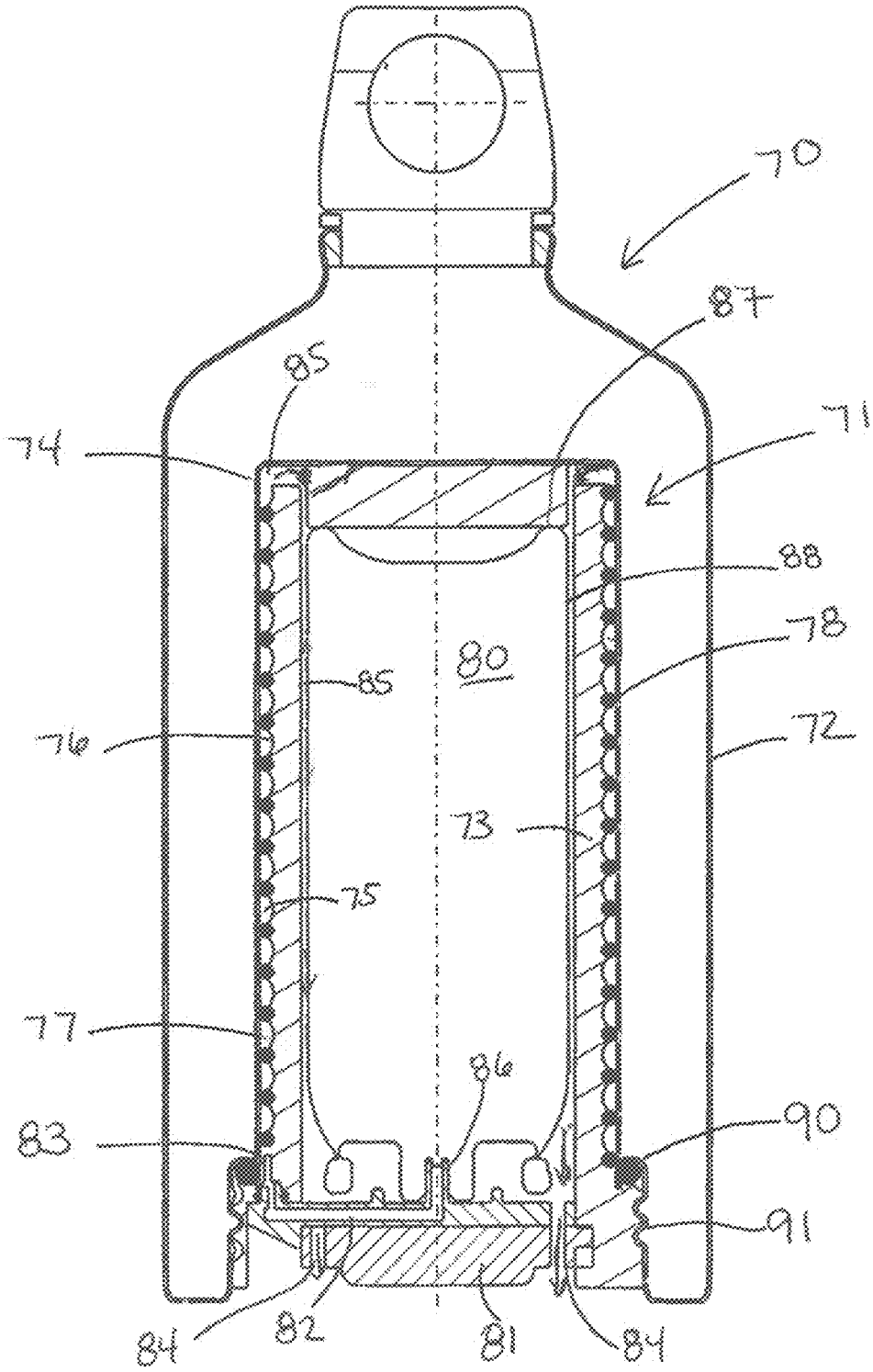
FIG. 5 illustrates a partial cross-sectional view of a cooling assembly according to another implementation.

It is important to note that any of a variety of other types of flow diverting elements 37 may be employed to form the tortuous fluid path 39. Further, it is important to note that the one or more flow diverting elements 37 may be formed independently of bodies 31 and 35 or formed as a part of one or both of the bodies 31 and 35. For example, according to some implementations the flow diverting elements 37 may extend from and form a part of the internal longitudinal body 35 as shown in FIGS. 1 and 2. According to some implementations, as shown in the example of FIG. 5, the flow diverting element 37 may comprise a spiral element that originates at or near the proximal end of bodies 31, 35 and terminates at or near a distal end of bodies 31, 35.

In the implementations shown in FIGS. 1A-C, the external longitudinal body 31 comprises an open proximal end (not labeled) and a closed distal end 58 with the internal longitudinal body 35 having been inserted into the internal chamber 34 via the open proximal end. According to some implementations the internal longitudinal body 35 comprises open proximal and distal ends 61 and 62, respectively, with the open proximal end 61 located at or near the open proximal end of body 31 and the open distal end 62 located spaced-apart and near the closed distal end 58 of body 31, there therefore being formed a coolant passage that extends between the outlet 41 of the tortuous fluid passage 39 and the cavity 38 of body 35.

As shown in FIGS. 1A-C, the cooling apparatus 30 includes a base 44 onto which are coupled the proximal ends of the internal and external longitudinal bodies 31 and 35.

According to some implementations the base 44 forms a part of, or is otherwise coupled to, a closure cap 45 that may be permanently or removably coupled to a bottom of the hand-held container 10. O-rings or other sealing members 46 may be disposed between the various parts to provide a fluid tight containment. Although not shown in the figures, the base 44 and/or a part of the closure cap 45 may have formed therein a reservoir for collecting any unevaporated coolant before the coolant is exhausted to the environment. The reservoir may comprise a recess or other suitable structure through which the coolant passes before being exhausted to the atmosphere.

Figure 4:
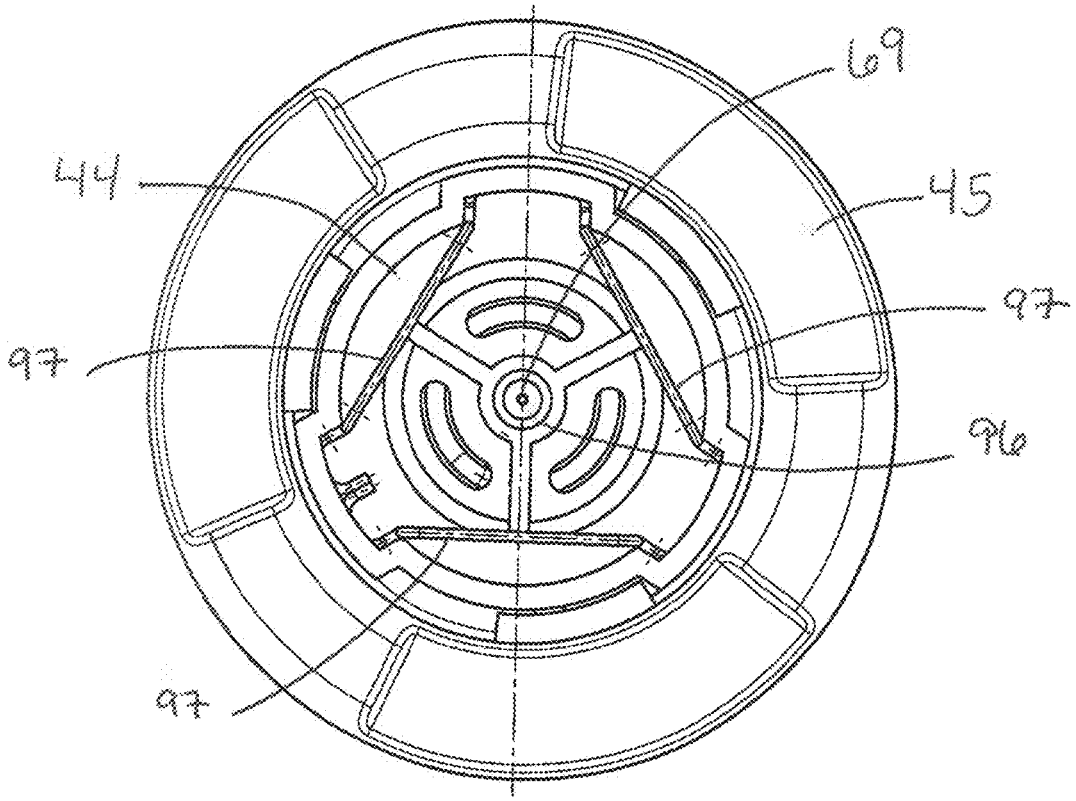
FIG. 4 illustrates a bottom view of a closure cap according to one implementation.

According to some implementations the base 44 includes a longitudinal wall section 57 that extends into the cavity 38 of the internal longitudinal body 35. The coils 53 of the pre-cooling assembly 50 are wound around or about the wall section 57. A purpose of the wall section 57 is to restrict the flow of the exhausting coolant to the area around the coils 53 in order to increase cooling efficiency. According to some implementations the coolant inlet 96 of assembly 1 extends into an internal cavity formed by the wall section 57 onto which the pre-cooling assembly inlet 51 is attached. Further, as shown in FIG. 4, a piercing element 69 may protrude from or otherwise reside in the coolant inlet conduit 96 that is configured to pierce through a containment wall at the exit of the coolant cartridge 60.

According to some implementations the cooling apparatus 30, base 44 and closure cap 45 are removable as a single unit from the container 10. In this manner, the closure cap 45 may, for example, be used during the summer months and be switched out with a closure cap without a cooling apparatus for winter use.

According to some implementations the dimensional characteristics of the internal longitudinal body may be as follows: Dimension A may vary between 100 and 150 millimeters; dimension B may vary between 20 and 40 millimeters; dimension C may vary between 15 and 30 millimeters, dimension D may vary between 1 and 3 millimeters, dimension E may vary between 2 and 5 millimeters; dimension F may vary between 0.4 and 1 millimeters; dimension G may vary between 3 and 6 millimeters. Further, according to some implementations the width dimension of the longitudinal through openings 37*b* may vary between 1 and 4 millimeters.

Figure 2B:
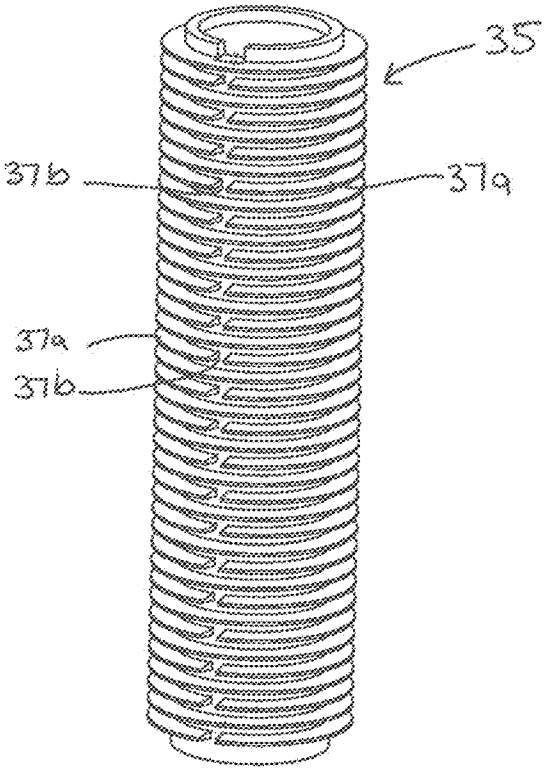
FIG. 2B shows a perspective view of the internal longitudinal body of FIG. 2A.
Figure 2A:
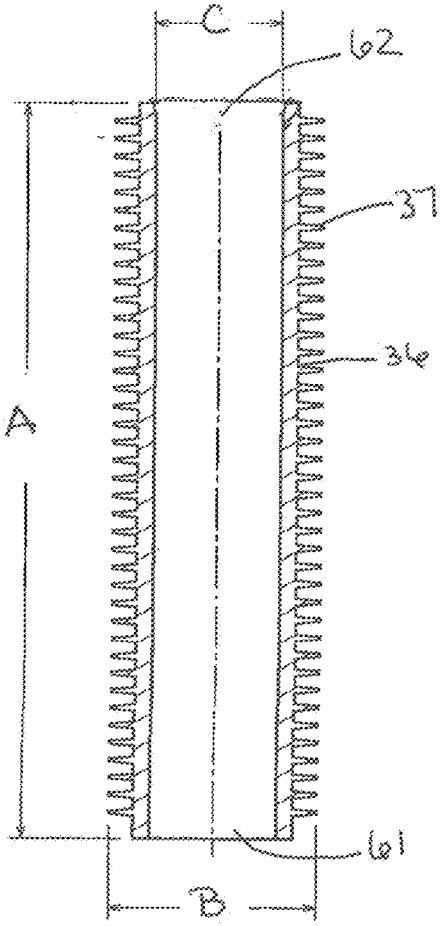
FIG. 2A shows a cross-sectional view of an internal longitudinal body of a heat exchanger according to one implementation.
Figure 2C:
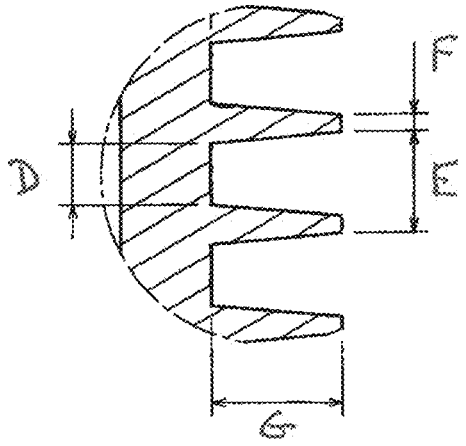
FIG. 2C is an enlarged cross-sectional view of ring elements of the internal longitudinal body of FIG. 2B.
Figure 2D:
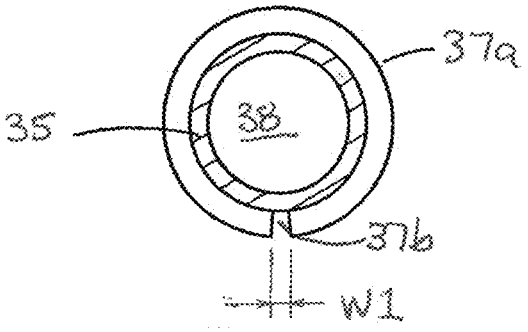
FIG. 2D shows a top cross-sectional view of a ring element according to one implementation.
Figure 2E:
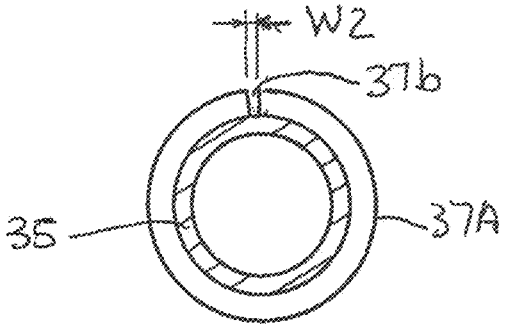
FIG. 2E shows a top cross-sectional view of a ring element adjacent the ring element of FIG. 2D according to one implementation.

As noted above, the width of the through openings 37*b* in the ring elements 37 may vary along the length of the body 35 as illustrated in FIGS. 2D and 2E wherein which the width dimension W1 (or cross-sectional area) of a through opening 37*b* in one ring element 37 is greater the width dimension W2 (or cross-sectional area) of a through opening 37*b* in another ring element 37. The purpose of including one or more through openings of reduced diameter (hereinafter referred to as "constrictions") is to create a backpressure in order to control the evaporation temperature of the coolant as it passes through the tortuous fluid passage 39. According to some implementations the location and cross-sectional area of the constrictions assist in minimizing or eliminating altogether the formation of ice on the exterior surface 32 of the external longitudinal body 31. According to some implementations this is achieved by regulating the evaporation temperature between +5 and −10° C., and preferably between +5 and −5° C. By providing a sequential drop or stepped drop in pressure along the length of the tortuous fluid passage 39 by use of the constrictions, evaporation may also be controlled to ensure that the coolant remains in an evaporated state as it passes from the tortuous fluid path 39 and into the cavity 38 of the internal longitudinal body 35. This is achieved by increasing the dwell time of the coolant inside the fluid passage 39. According to some implementations the cross-sectional area of the constrictions diminish or increase along the length of the tortuous fluid passage 39 between the coolant inlet 40 and coolant outlet 41. According to other implementations the cross-sectional area of each of the constrictions is substantially the same along the length of the tortuous fluid passage 39 between the coolant inlet 40 and coolant outlet 41. According to some implementations the constrictions have a diameter of less than 1 millimeter.

According to some implementations the volume of the liquid to be cooled within the hand-held liquid container 10 is between about 0.5 and 0.75 liters. As will be explained in more detail below, it is preferable that the liquid to be cooled occupy less than the entire available volume inside the container 10. In order to facilitate a rapid cooling of the liquid (e.g. a temperature drop of ≥10° C. within one minute), according to some implementations the external longitudinal body 31 has an exposed surface area of between 120 and 160 $cm^2$ and occupies a volume of between 100 and 150 $cm^3$ inside the cavity 12 of container 10. According to such implementations the tortuous fluid passage 39 is provided with a volume of between 30 and 50 $cm^3$.

Figure 3:
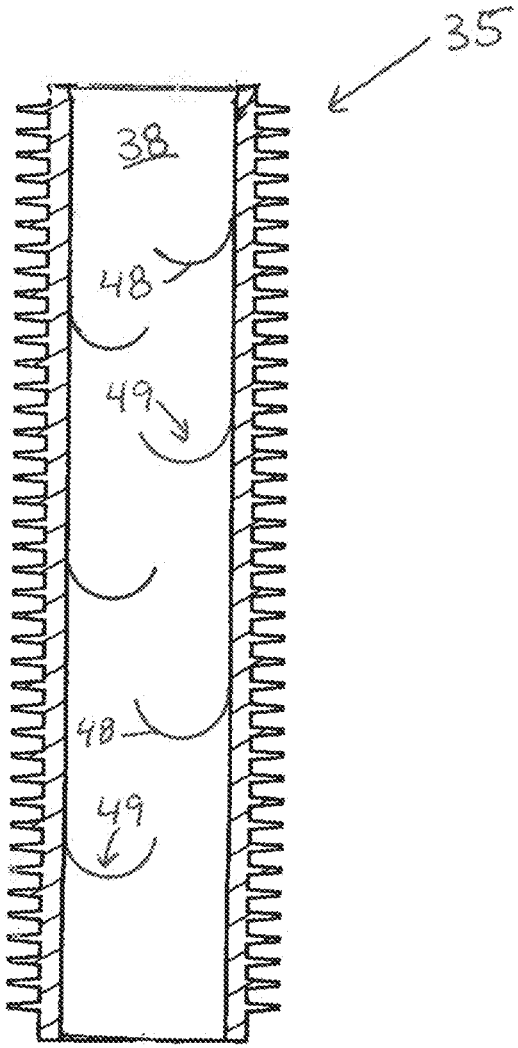
FIG. 3 shows a cross-sectional view of an internal longitudinal body according to another implementation.

According to some implementations a series of longitudinally distributed baffles 48 may also be located within the internal cavity 38 of the internal longitudinal body 35. As shown in FIG. 3 the baffles 48 may comprise reservoirs 49 for the purpose of collecting coolant that remains unevaporated upon exiting the tortuous fluid conduit 39 and entering the cavity 38 of body 35.

According to some implementations the coolant cartridge 60 includes a lip 65 and may be attached to the base 44 and/or closure cap 45 via one or more clips 97 that fit over and engage with the lip 65 as shown in FIGS. 1 and 4. In the implementation of FIG. 4 three clip elements 97 are provided in the form of elongate flexible members that flex outwardly to receive the lip 65 and then flex back inwardly to reside in an external recess 66 located just below the lip 65 to effectuate an attachment of the cartridge 60 to the hand-held liquid container 10.

According to some implementations a method for cooling a liquid includes: (i) obtaining a portable liquid container having disposed in a cavity therein a heat exchanger configured for cooling a liquid, (ii) partially filling the cavity of the portable container with a liquid, (iii) connecting a cooling source to the heat exchanger to initiate a flow of a cooling medium through the heat exchanger, and (iv) shaking the portable container while the cooling medium is being delivered through the heat exchanger. According to some implementations the liquid container may include a fill-line 68 (see FIG. 1A) located below an opening of the container through which the liquid is introduced into the container and the step of partially filling the cavity of the hand-held liquid container comprises adding the liquid to the cavity to a level at or below the fill-line. According to some implementations, as shown in FIG. 1A, the fill-line is located a distance below the opening 11 of the container 10 and above or at the top surface of the external longitudinal body 31. By providing a void space in the portable container 10 and also shaking the container, the heat transfer rate from the liquid to the coolant through the wall of the external longitudinal body 31 is increased.

Turning now to FIG. 5, an assembly 70 is provided that includes a heat exchanger 71 disposed inside a hand-held liquid container 72. The heat exchanger 71 includes an internal longitudinal body 73 located inside an external longitudinal body 74. The construction of the heat exchanger 71 may be similar to those described above with there being one or more flow diverting elements 78 disposed between the internal surface 75 of the external longitudinal body 74 and the external surface 76 of the internal longitudinal body 73 to form a tortuous fluid passage 77 between the two bodies.

As explained above, any of a variety of types of flow diverting elements may be employed to form the tortuous fluid passage 77. Also, as explained above, the one or more flow diverting elements may be formed independently of bodies 73 and 74 or may be formed as a part of one or both of the bodies 73 and 74. According to some implementations, as shown in FIG. 5, the flow diverting element may comprise a spiral element that originates at or near the proximal end of bodies 73, 74 and terminates at or near a distal end of bodies 73, 74. Other configurations are also possible.

In the implementation of FIG. 5 the internal cavity of the internal longitudinal body 73 is configured to receive therein a coolant cartridge 80. According to some implementations the external surface 88 of the coolant cartridge 80 is spaced-apart from the inner surface 85 of the internal longitudinal body 73 in order to provide an exhaust path for the coolant as illustrated by the arrows in FIG. 5.

According to some implementations the internal and external longitudinal bodies 73,74 are coupled to one another at or near a base 81 of the bodies. An O-ring or other sealing element 90 may be disposed between the bodies 73, 74 to provide a fluid tight seal there between. The bodies 73, 74 may in turn be permanently or releasably coupled to the body of the hand-held liquid container 72. In the implementation of FIG. 5, the internal longitudinal body 73 is releasably coupled to the body of the liquid container 72 via a threaded connection 91.

Coolant flow from the cartridge 80 into the inlet 83 of the tortuous fluid passage 77 occurs through a base 81 that has a coolant channel 82 that connects the outlet of the cartridge 80 to the inlet 83. The base 81 may be coupled to the body of the container 72 or to the internal longitudinal body 73 as illustrated in FIG. 5. According to some implementations the base 81 includes one or more coolant exhaust ports 84 that enables coolant to flow to the atmosphere after having passed through the tortuous fluid passage 77 and the space between the outside surface of the cartridge 80 and the inside surface of body 73. According to some implementations the base 81 also includes a piercing element 86 configured to pierce through a containment wall at the exit of the coolant cartridge 80. Upon the piercing element 86 being positioned to pierce through the containment wall at the exit of the coolant cartridge 80, coolant flow is initiated through the heat exchanger 71 by first passing through the coolant channel 82 and into the inlet 83 of the tortuous fluid passage 77. Upon passing through passage 77, the coolant exits the passage 77 at an end 85 of the heat exchanger opposite the base 81. The coolant then flows between the space between the coolant cartridge 80 and body 73 and exits the assembly 70 through the one or more exit ports 84.

In the foregoing disclosure the cooling assemblies have been described in conjunction with the use hand-held liquid containers. It is appreciated, however, that the invention is applicable to any of a variety of portable devices, such as backpack hydration systems, wine coolers, etc.

The particular features, structures or characteristics of any implementation described above may be combined in any suitable manner, as would be apparent to one of ordinary skill in the art from this disclosure, in one or more implementations. Similarly, it should be appreciated that in the above description of implementations, various features of the inventions are sometimes grouped together in a single implementation, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed implementations. The claims following the Detailed Description are hereby expressly incorporated into this Detailed Description, with each claim standing on its own as a separate implementation.

What is claimed is:

1. A cooling apparatus comprising:

a first longitudinal body having a first outer surface and a first inner surface, the first inner surface defining an internal chamber having first and second ends, a second longitudinal body disposed inside the first longitudinal body, the second longitudinal body having a second outer surface and a second inner surface, the second outer surface facing and being spaced-apart from the first inner surface of the first longitudinal body, the second inner surface defining an internal cavity having first and second ends, the first end being disposed in proximity to the first end of the internal chamber of the first longitudinal body, the second end being disposed in proximity to the second end of the internal chamber of the first longitudinal body, a tortuous conduit disposed between and along a length of the first and second longitudinal bodies, the tortuous conduit being defined in part by the inner surface of the first longitudinal body, the tortuous conduit having an outlet and an inlet that are respectively disposed in proximity to the first and second ends of the internal chamber of the first longitudinal body, the tortuous conduit outlet being in fluid communication with the internal cavity of the second longitudinal body, the tortuous conduit comprising a plurality of flow constrictors disposed within an intermediate portion thereof, the plurality of flow constrictors having different cross-sectional areas than one another.

2. A cooling apparatus according to claim 1, further comprising a coolant exhaust duct that exhausts to the atmosphere and that is in fluid communication with the second end of the internal cavity of the second longitudinal body.

3. A cooling apparatus according to claim 1, wherein when a coolant is passed through the tortuous conduit, the one or more flow constrictors are configured to cause an increase in a dwell time of the coolant inside the tortuous conduit.

4. A cooling apparatus according to claim 1, wherein when a coolant is passed through the tortuous conduit the one or more flow constrictors are located and configured to effectuate an increase of an exhaust temperature of the coolant within the coolant exhaust duct.

5. A cooling apparatus according to claim 1, wherein the first longitudinal body comprises a first material having a first thermal conductivity and the second longitudinal body comprises a second material having a second thermal conductivity that is less than the first thermal conductivity.

6. A cooling apparatus according to claim 1, wherein the second longitudinal body comprises a plurality of radially extending and axially spaced apart members that form in part the tortuous conduit.

7. A cooling apparatus according to claim 6, wherein the plurality of radially extending and axially spaced apart members comprise ring elements having a through opening formed longitudinally therein, at least one or more of the through openings comprising the one or more constrictors, the through openings of axially adjacent ring elements not being longitudinally aligned with one another.

8. A cooling apparatus according to claim 7, wherein the through opening of at least some of the ring elements are longitudinally aligned with one another.

9. A cooling apparatus according to claim 7, wherein the through opening of adjacent ring elements are spaced one hundred eighty degrees apart.

10. A cooling apparatus according to claim 1, wherein the plurality of flow constrictors of different cross-sectional areas are configured to create a backpressure in the tortuous conduit when a coolant is passed through the tortuous conduit.

11. A cooling apparatus according to claim 1, wherein the plurality of flow constrictors includes a first flow constrictor having a first cross-sectional area and a second flow constrictor having a second cross-sectional area, the first flow constrictor being located nearer the inlet of the tortuous conduit than the second flow constrictor, the second cross-sectional area being greater than the first cross-sectional area.

12. A cooling apparatus according to claim 1, wherein the plurality of flow constrictors includes a first flow constrictor having a first cross-sectional area and a second flow constrictor having a second cross-sectional area, the first flow constrictor being located nearer the inlet of the tortuous conduit than the second flow constrictor, the second cross-sectional area being less than the first cross-sectional area.

13. A cooling apparatus according to claim 1, wherein the second longitudinal body comprises a plurality of radially extending and axially spaced apart members that form in part the tortuous conduit, the plurality of flow constrictors comprising through holes in the plurality of radially extending and axially spaced apart members.

14. A cooling apparatus according to claim 13, wherein the plurality of radially extending and axially spaced apart members comprise ring elements having the through openings respectively formed longitudinally therein, the through openings of axially adjacent ring elements not being longitudinally aligned with one another.

* * * * *